US006092500A

United States Patent [19]

Frank et al.

[11] Patent Number: 6,092,500

[45] Date of Patent: Jul. 25, 2000

[54] FUEL DELIVERY DEVICE

[75] Inventors: Kurt Frank, Schorndorf; Detlef Classe, Nuremberg; Albert Gerhard, Tamm; Ulrich Projahn, Leonberg, all of Germany

[73] Assignee: Robert Bosch GmbH, Stuttgart, Germany

[21] Appl. No.: 09/180,444

[22] PCT Filed: Jan. 7, 1998

[86] PCT No.: PCT/DE98/00009

§ 371 Date: Nov. 6, 1998

§ 102(e) Date: Nov. 6, 1998

[87] PCT Pub. No.: WO98/40621

PCT Pub. Date: Sep. 17, 1998

[30] Foreign Application Priority Data

Mar. 7, 1997 [DE] Germany ..... 197 09 446

[51] Int. Cl.[7] ..... F02M 39/00; F02M 77/08

[52] U.S. Cl. ..... 123/198 D; 123/198 DB; 123/447

[58] Field of Search ..... 123/198 D, 198 DB, 123/447, 467

[56] References Cited

U.S. PATENT DOCUMENTS 3,620,204 11/1971 Baltadonis ..... 123/198 D
4,054,116 10/1977 Coddington ..... 123/198 DB
4,249,497 2/1981 Eheim et al. ..... 123/446
4,926,815 5/1990 Cowley ..... 123/198 DB
4,957,084 9/1990 Kramer et al. ..... 123/447
5,159,911 11/1992 Williams et al. ..... 123/467
5,441,026 8/1995 Akimoto ..... 123/198 D
5,765,535 6/1998 Radermacher ..... 123/497
5,967,120 10/1999 Blanton et al. ..... 123/467

*Primary Examiner*—Erick Solis
*Assistant Examiner*—Brian Hairston
*Attorney, Agent, or Firm*—Ronald E. Greigg; Edwin E. Greigg

[57] ABSTRACT

A delivery device for fuel to an internal combustion engine, which includes a fuel reservoir. After the engine is shut off or in the event of an accident, there is the danger that the pressurized fuel present in the fuel reservoir will escape from the delivery device. A blocking device is provided on the fuel reservoir, which after the engine is shut off or after an accident, the blocking device engages with an actuation rod that is provided with detent teeth, by means of an electromagnetically actuated locking pin and thus prevents a force impingement of a compression spring on the movable wall of the fuel reservoir. By use of the blocking devices the pressure in the fuel line is completely reduced even after the escape of small fuel quantities. The delivery device is suited for mixture-compressing internal combustion engines with externally supplied ignition.

7 Claims, 1 Drawing Sheet

FUEL DELIVERY DEVICE

PRIOR ART

The invention is based on a fuel delivery device. Fuel delivery devices have already been disclosed, in which the fuel is pumped into a fuel reservoir, by means of which the injection system of the internal combustion engine of a motor vehicle can also be supplied from this fuel reservoir. In this connection, due to leaky injection valves, there is the danger when shutting off the engine that the fuel, which is stored in the fuel reservoir and kept under pressure by the fuel reservoir, will leak out through the leaky injection valves in an undesirable manner. Furthermore, there is the danger that when the motor vehicle is in an accident, the fuel line will be damaged and the fuel stored in the fuel reservoir will escape at this damaged point.

ADVANTAGES OF THE INVENTION

The delivery device according to the invention, has the advantage over the prior art that fuel is prevented in a simple manner from escaping from the fuel reservoir in an uncontrolled manner after the shutting off of the engine or after an accident.

Advantageous improvements and updates of the delivery device disclosed are possible by means of the measures taken hereinafter.

It is particularly advantageous, after the engine is shut off or after an accident, to lock a movable wall of the fuel reservoir, which exerts a compressive force on the fuel, in place by means of the blocking device, by means of which even after the escape of a very small quantity of fuel from the fuel injection system, the pressure of the fuel in the fuel injection system is reduced until fuel only continues to flow due to the force of gravity. At the same time, the blocking device advantageously has an actuation rod connected to the movable wall and when the engine is shut off or in the event of an accident, an electromagnetically actuated locking pin engages in a locking fashion in this actuation rod and consequently prevents a force acting on the movable wall in the direction of the fuel.

It is likewise advantageous to dispose a stop valve as the blocking device, in the fuel line downstream of the fuel reservoir, which valve shuts off the fuel line to the fuel reservoir after the engine is shut off or after an accident, so that the pressure produced by the fuel reservoir is no longer in effect downstream of the stop valve and no fuel can continue to flow from the fuel reservoir. The stop valve can advantageously be actuated electromagnetically. When the stop valve is closed, in order to prevent fuel that is enclosed between the stop valve and the injection valves from causing damage after the engine is shut off due to the after-heating phase by means of the engine, it is advantageous to dispose a pressure relief valve in a bypass line to the stop valve, which pressure relief valve opens toward the fuel reservoir and can be integrated into the stop valve.

BRIEF DESCRIPTION OF THE DRAWINGS

Exemplary embodiments of the invention are shown in a simplified form in the drawings and will be explained in more detail in the subsequent description.

DESCRIPTION OF THE EXEMPLARY EMBODIMENTS

Figure 1:
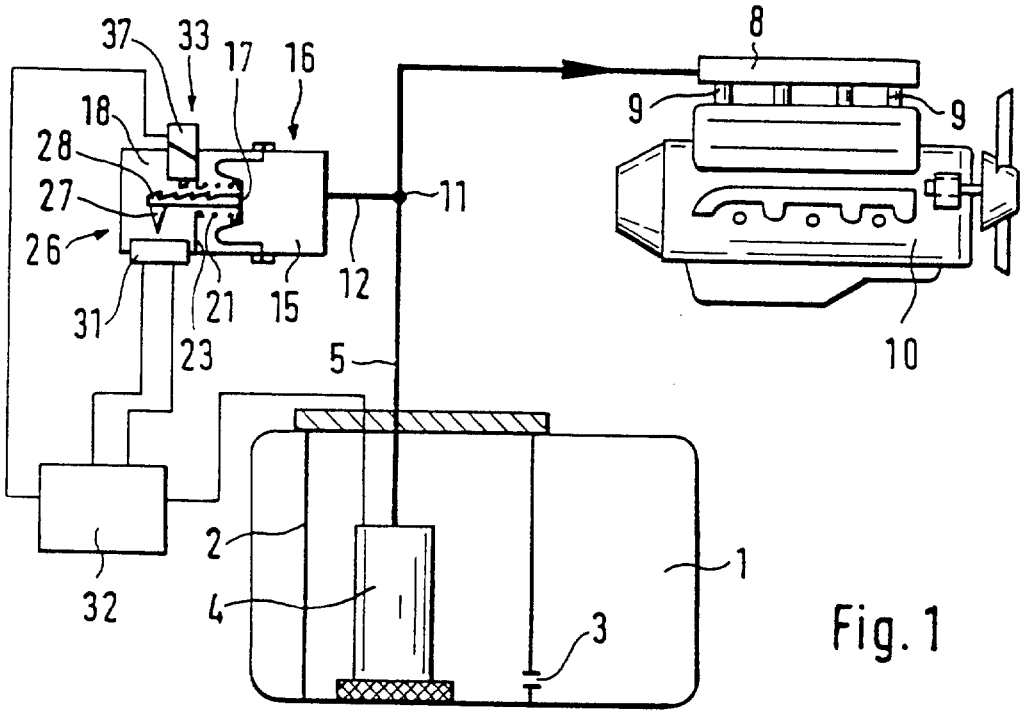
FIG. 1 is a schematic representation of a delivery device for fuel to an internal combustion engine, with a fuel reservoir.

In FIG. 1, the number 1 indicates a fuel tank into which a so-called tank component 2 is inserted, which is supplied with fuel from the fuel tank 1 by way of a compensation opening 3 in the wall of the tank component. A fuel pump 4 is disposed in the tank component 2 and this pump is driven, for example, by means of an electric motor and supplies fuel into a fuel line 5 outside the fuel tank 1. The fuel line 5 feeds into a so-called fuel distributor 8, from which fuel travels into injection valves 9, which are inserted into the fuel distributor and of which, for example, four are shown. The injection valves 9 are respectively inserted with their injection side ends into a single intake tube of a cylinder of a mixture-compressing internal combustion engine 10 with externally supplied ignition and inject fuel in the immediate vicinity of inlet valves of the individual cylinders.

Figure 2:
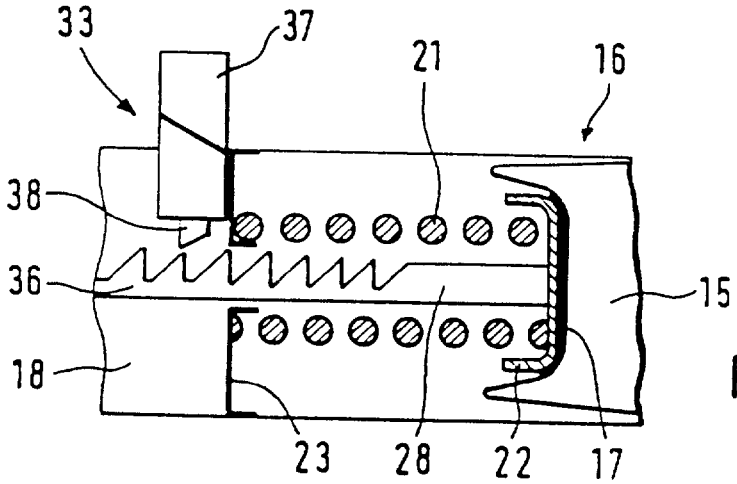
FIG. 2 shows a partial detail of a fuel reservoir according to FIG. 1, in a different scale.

Outside the fuel tank 1, a branch line 12 branches off from the fuel line 5 at a branching point 11 and is connected to a fuel chamber 15 of a fuel reservoir 16. In lieu of the branch line 12, the fuel chamber 15 can also be connected directly to the fuel line 5 in a manner not shown so that the fuel flowing to the fuel distributor 8 is conveyed completely by means of the fuel chamber 15. Inside the fuel reservoir 16, the fuel chamber 15 is divided from an opposing chamber 18 by means of a movable wall 17 which is constituted, for example, by means of a membrane as is also shown in FIG. 2. A piston guided in a sealed fashion in the fuel reservoir 16 can also serve as the movable wall 17. The fuel reservoir 16 is embodied as a pressure reservoir, wherein with the exemplary embodiment shown, a compression spring 21 is provided to generate the compressive force and is disposed in the opposing chamber 18 and rests with its one end against a spring plate 22 that engages the movable wall 17 and rests with its other end against a dividing wall 23 that passes through the opposing chamber 18. In lieu of the compression spring 21, the compressive force on the movable wall 17 can also be produced in the opposing chamber 18 pneumatically or hydraulically in a manner not shown or by means of the action of a magnetic or electromagnetic force on the movable wall 17. The opposing chamber 18 of the fuel reservoir 16 also has a control device 26 disposed in it, which has a contact 27 that can be actuated by the movement of the movable wall 17. The contact 27 is, for example, connected to an actuation rod 28, which is connected to the spring plate 22 and passes through the dividing wall 23, and produces either an adjustment of the supply current for the fuel pump 4 by way of an adjusting resistor 31 or by way of an on/off control as a function of the fuel level in the fuel reservoir 16. A control of this kind can, for example, be inferred from the German patent application 196 25 754, whose disclosure content should apply here as well. The system pressure of the fuel injection system in the fuel line 5 to the injection valves 9 is thereby determined directly by the pressure produced by means of the fuel reservoir 16. The current pressure in the fuel reservoir 16 is therefore equal to the pressure prevailing in the fuel line 5; additional pressure regulating elements are not necessary. The regulation of the fuel pump 4 takes place by means of an electronic control device 32, which receives signals of the adjusting resistor 31 by way of electrical lines and triggers the fuel pump 4.

After the engine 10 is shut off, there is the danger that as a result of leaky injection valves 9, the fuel of the fuel reservoir 16 present in the fuel chamber 15 will leak completely out through the injection valves 9 into the engine 10 in an undesirable manner due to the compressive force on the movable wall 17. There is also the danger that when the vehicle is involved in an accident, the fuel line 5 will be damaged and despite the fuel pump 4 being switched off, fuel will escape from the damaged fuel line 5 into the engine compartment since the fuel present in the fuel chamber 15 of the fuel reservoir 16 will be displaced into the fuel line 5 due to the compressive force acting on the movable wall 17. As a result of this, there is the danger of a fire or an explosion. In order to assure that no fuel from the fuel reservoir 16 will be subsequently displaced into the fuel line 5 after the engine 10 is shut off or in the event of an accident, a blocking device 33 is provided, which in these instances permits a reduction of the fuel pressure downstream of the fuel reservoir 16. To this end, in the first exemplary embodiment according to FIGS. 1 and 2, the blocking device 33 is embodied in such a way that it locks the movable wall 17 of the fuel reservoir 16 in place after the engine 10 is shut off. For this purpose, the actuation rod 28 is embodied as a toothed rod and has detent teeth 36. Furthermore, the blocking device 33 has an electromagnet 37 that is supported on the fuel reservoir and protrudes into the opposing chamber 18, by means of which a locking pin 38 oriented toward the detent teeth 36 can be actuated. In normal operation of the engine 10, the locking pin 38 is disposed so that it does not engage with the detent teeth 36, which are embodied, for example, like saw teeth, so that the actuation rod 28 can follow the movement of the movable wall 17 unhindered and the force of the compression spring 21 acts on the movable wall 17 in an unhindered manner. After the engine 10 is shut off or in the event that the vehicle is in an accident, which is signalized by a so-called crash sensor of the kind also used to trigger the air bag, the electromagnet 37 of the blocking device 33 is triggered by the electronic control device 32 in such a way that the locking pin 38 is slid in the direction of the detent teeth 36 and engages in one of the detent teeth 36. As a result, the action of the compression spring on the movable wall 17 is prevented and due to the incompressibility of the fuel, the escape of a minimal fuel quantity from the fuel line 5 is sufficient to completely reduce the fuel pressure prevailing in it to atmospheric pressure, which prevents a further escape of fuel from the fuel reservoir 16.

Figure 3:
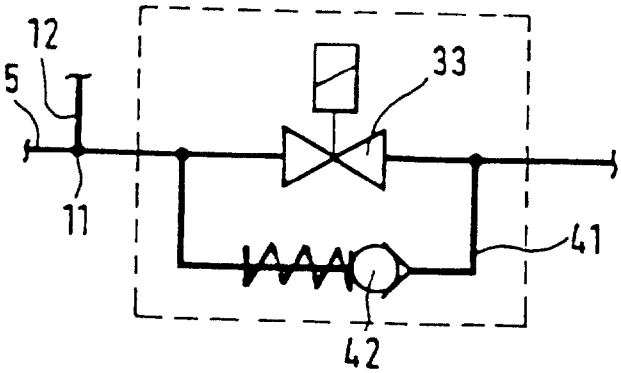
FIG. 3 shows a blocking device in a fuel line.

In the second exemplary embodiment according to FIG. 3, only a detail of the delivery device according to FIG. 1 is depicted, wherein the parts that remain the same and have the same functions are identified by the same reference numerals. No blocking device is provided on the fuel reservoir 16 in FIG. 3, but a stop valve is provided as a blocking device, downstream of the fuel reservoir 16 or the branching point 11 in the fuel line 5 and this stop valve is controlled in an electromagnetically actuated manner by the electronic control device 32 and is open in the normal operation of the engine, whereas after the engine is shut off or after an accident, the blocking device 33 that is embodied as a stop valve 33 is closed and consequently the connection from the fuel reservoir 16 to the injection valves 9 or to the section of the fuel line 5 downstream of the blocking device 33 is interrupted. In the after-heating phase after the engine is shut off, in order to prevent fuel-carrying components from bursting due to the heat expansion of fuel due to the now un-cooled engine which is heating the engine compartment, a bypass line 41 to the stop valve 33 is provided, in which a pressure relief valve 42 is disposed, which opens toward the fuel reservoir 16. For example, the pressure relief valve 42 is integrated into the stop valve 33 to form a unit that is represented with dashed lines in FIG. 3.

The foregoing relates to a preferred exemplary embodiment of the invention, it being understood that other variants and embodiments thereof are possible within the spirit and scope of the invention, the latter being defined by the appended claims.

What is claimed is:

1. A delivery device for fuel from a fuel tank to an internal combustion engine, comprising a fuel pump, with a fuel line into which the fuel pump feeds fuel from the fuel tank, a fuel distributor into which the fuel line feeds, a fuel reservoir which is connected to the fuel line and produces a pressure in the fuel, and a blocking device (33) which permits a reduction of the fuel pressure downstream of the fuel reservoir (16) after the engine (10) is shut off or after an accident, a movable wall (17) of the fuel reservoir (16) which exerts a compressive force on the fuel is locked in place by means of the blocking device (33) after the engine (10) is shut off or after an accident.

2. A delivery device according to claim 1, in which the blocking device (33) has an actuation rod (28) that has detent teeth (36) and is connected to the movable wall (17), and said rod is engaged in a locking fashion by an electromagnetically actuated locking pin (38) when the engine (10) is shut off or in the event of an accident.

3. A delivery device for fuel from a fuel tank (1) to an internal combustion engine (10), comprising a fuel pump (4), with a fuel line (5) into which the fuel pump feeds fuel from the fuel tank, a fuel distributor (8) into which the fuel line feeds fuel that is directed to fuel injection valves (9), a fuel reservoir (16) which is connected to the fuel line and produces a pressure in the fuel, and a stop valve (33) that is disposed in the fuel line (5) downstream of the fuel reservoir (16), said stop valve shuts off the fuel line (5) between the fuel distributor (8) and the fuel reservoir (16) and between the fuel distributor and the fuel pump after the engine is shut off or after an accident.

4. A delivery device according to claim 3, in which the stop valve (33) can be electromagnetically actuated.

5. A delivery device according to claim 3 in which a pressure relief valve (42) that is opened in the direction of the fuel reservoir (16) and in the direction of the fuel pump is disposed in a bypass line (41) in parallel with the stop valve (33).

6. A delivery device according to claim 5, in which the pressure relief valve (42) is integrated into the stop valve (33).

7. A delivery device according to claim 4, in which a pressure relief valve (42) that is opened in the direction of the fuel reservoir (16) and in the direction of the fuel pump is disposed in a bypass line (41) in parallel with the stop valve (33).

* * * * *